United States Patent [19]

Nerlinger

[11] 4,430,015

[45] Feb. 7, 1984

[54] FASTENING MEANS FOR MAKING INSERTS IN WIRE BOUND NOTEBOOKS AND THE LIKE

[75] Inventor: John J. Nerlinger, Dayton, Ohio

[73] Assignee: Mead Corporation, Dayton, Ohio

[21] Appl. No.: 271,336

[22] Filed: Jun. 6, 1981

[51] Int. Cl.[3] ..... B42F 13/00

[52] U.S. Cl. ..... 402/79; 402/500

[58] Field of Search ..... 402/19, 24, 25, 79, 402/500, 501, 502, 503; 281/21 A

[56] References Cited

U.S. PATENT DOCUMENTS

| | | | |
|---|---|---|---|
| 717,957 | 1/1903 | Weaver . | |
| 818,130 | 4/1906 | Swan . | |
| 1,107,351 | 8/1914 | Proudfit . | |
| 1,222,058 | 4/1917 | McCullough | 281/43 |
| 2,039,752 | 5/1936 | Thomas | 402/79 |
| 2,232,058 | 2/1941 | Farkas et al. | 281/43 |
| 2,681,655 | 6/1954 | Schade . | |
| 2,808,871 | 10/1957 | Brown | 402/79 |
| 2,848,163 | 8/1958 | van Horne Serrell | 402/501 |
| 3,270,874 | 9/1966 | Hilton | 206/86 |
| 3,315,683 | 4/1967 | Rodriguez et al. | 402/79 |
| 3,685,857 | 8/1972 | Schlieben | 402/501 X |
| 3,719,161 | 3/1973 | Wegner | 281/42 X |
| 3,899,842 | 8/1975 | Schneider | 402/501 X |
| 4,193,704 | 3/1980 | Miller | 402/19 |

FOREIGN PATENT DOCUMENTS

| | | | |
|---|---|---|---|
| 1022036 | 12/1952 | France | 402/79 |
| 2383024 | 6/1978 | France . | |
| 222706 | 10/1924 | United Kingdom | 402/501 |
| 485477 | 5/1938 | United Kingdom | 402/79 |
| 643124 | 9/1950 | United Kingdom . | |
| 1280156 | 7/1972 | United Kingdom | 402/79 |

*Primary Examiner*—Paul A. Bell
*Assistant Examiner*—John S. Brown
*Attorney, Agent, or Firm*—Biebel, French & Nauman

[57] ABSTRACT

A fastening means for attaching documents and other items to the wire binder of notebooks, tablets and the like is disclosed. The fastener comprises a plurality of tabs positioned adjacently such that they form a notch which opens on and provides access to an aperture in which the wire binder is retained upon insertion of the fastening means into a notebook or similar wire bound medium. The opening between the notch and aperture formed by the tabs is smaller than the diameter of the wire forming the binder. In one embodiment the tabs are formed with a bulbous head. In another embodiment the head is formed with at least one oblique side and the neck is formed with at least one arcuate side.

6 Claims, 8 Drawing Figures

FASTENING MEANS FOR MAKING INSERTS IN WIRE BOUND NOTEBOOKS AND THE LIKE

BACKGROUND OF THE INVENTION

The present invention relates to a fastener for inserting and attaching documents and other items to a wire bound medium such as a notebook or tablet.

Wire bound notebooks and, particularly, spiral wire bound notebooks are familiar to the student, office worker, record keeper and stationarie. While the spiral wire binder ensures a permanent record and prevents accidental separation of the documents it retains, its chief shortcoming is that it is impractical for making insertions. In fact, from the standpoint of making insertions, the spiral wire binder is as unsuitable as it is suitable for preserving a permanent record. Typically, in order to make an insert into a wire bound volume such as a notebook, the user is forced to fold the documents and place them unattached between adjacent leaves of the notebook or to attach the insert using a clip, staple, or an adhesive tape. More often than not, additions remain unattached in the notebook and they are easily lost or misplaced. While clips and the like offer a degree of permanence, very often it is desired to make the insert at a point in the notebook which has already been recorded with information or data. In this case, when the insert is attached it must overlay a portion of the recorded information making that information inaccessible particularly to a brief scanning of the notebook pages. Thus, while the wire bound notebook is a widely used and convenient medium for maintaining records, better means are required for making insertions and additions.

There have been a variety of approaches to the problem of making inerts of wire bound media in the art. Some of these are illustrated in U.S. Pat. No. 4,193,704 and French Patent No. 7707732. While these patents share the objective of the present invention, they are designed differently and do not have its advantages. The fastener disclosed in U.S. Pat. No. 4,193,704 is designed with structurally dissimilar tab and hook portions. In the adaptor featured in French Patent No. 7707732 access to the wire retaining apertures is through a narrow slot or channel. This fastener design is subject to wear and is more susceptible to tear damage than the invention fastener.

SUMMARY OF THE INVENTION

It is a principal object of the present invention to provide a convenient means for fastening inserts into a spiral or wire bound volume such as a notebook, tablet, or other medium.

It is another object of the present invention to protabs the opening widens to admit the wire and when the tab returns to its normal unflexed position the opening closes to retain the wire.

The tabs are formed with head and neck portions. In one embodiment of head is bulbous. In another embodiment the head is formed with an oblique side and provides a generally V-shaped notch.

The fastening means of the present invention is conveniently embodied in a marginal strip which can be attached to the document or other item it is desired to insert into the wire bound volume. It may also be embodied in a card or divider which is inserted into the volume to, for example, identify predetermined sections of the volume or to locate a particular page or leaf. The fastening means of the present invention may also be incorporated along one side of a pencil or supply pouch and used to fasten the pouch to the inside of a notebook, for example.

BRIEF DESCRIPTION OF THE DRAWINGS

The present invention is described in more detail below by reference to the accompanying drawings wherein.

DETAILED DESCRIPTION OF THE INVENTION

Figure 1:
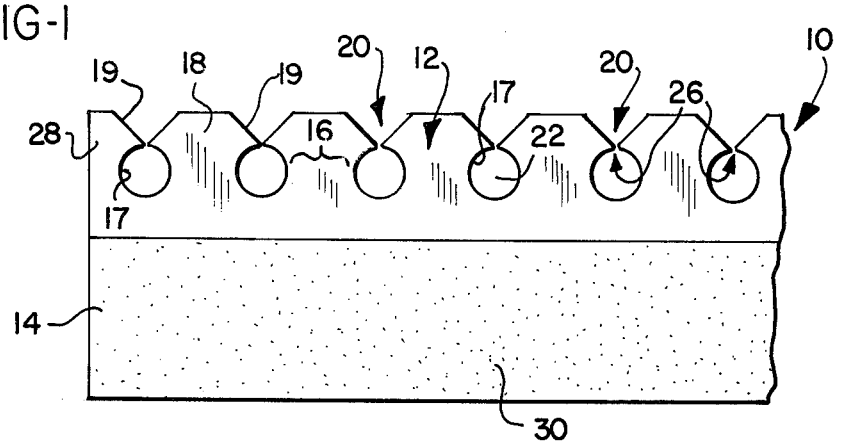
FIG. 1 is a partial plan view of a fastening means in accordance with the present invention.

The fastening means of the present invention is generally designated by the numeral 10 in FIG. 1. The fastening means comprises a plurality of tabs 12 adjacently positioned on a base strip 14. Each tab is formed with a head portion and a neck portion which respectively define a notch and an aperture in the space between the tabs. In FIG. 1 each tab is formed with a neck portion 16 having at least one arcuate side 17 and a head portion 18 having at least one oblique side 19 such that in the space between the tabs, the oblique sides 19 on adjacent tabs form a notch 20 which opens at opening 26 onto an aperture 22 formed between the adjacent arcuate sides 17 on the neck portions. The base strip 14 may also manner, once attached to the wire, the fastener cannot be inadvertently removed from the notebook by the stresses encountered in normal handling as explained below.

Figure 5:
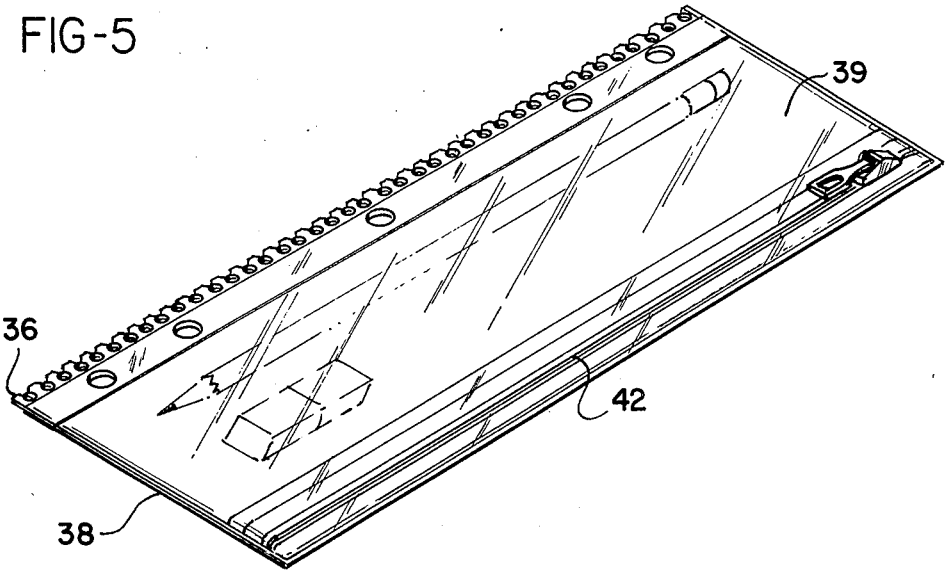
FIG. 5 is a perspective view of a pencil pouch equipped with the fastening means of the invention.
Figure 6:
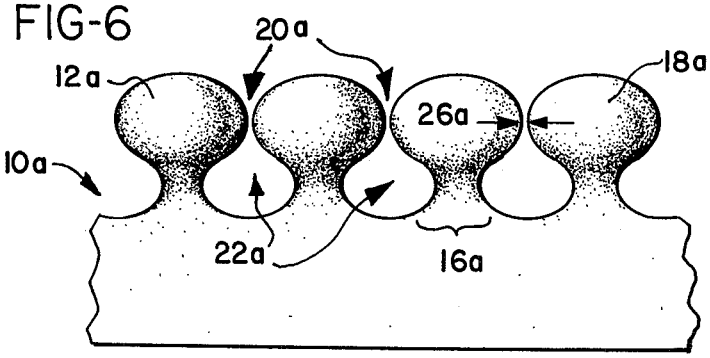
FIG. 6 is a partial plan view of a fastener having a bulbous head.

In another embodiment of the invention as shown in FIG. 6, the fastener 10*a* comprises tabs 12*a* in which the head 18*a* is bulbous and the neck 16*a* is a post. This embodiment is particularly useful when the fastener occurs in an injection-molded article such as those mentioned below and the utility pouch shown in FIG. 5. The head portion 18*a* of the tab 12*a* is shown as a spheroid in FIG. 6 but it will be apparent that the head may be spherical and other oblate shapes can be adapted to this design. The adjacent head portions 18*a* of the tabs 12*a* form a notch 20*a* which opens directly on aperture 22*a* formed between the adjacent posts 16*a*. The opening 26*a* between the notch 20*a* and the aperture 22*a* may be a slit with the head portions 18*a* of the tabs 12*a* barely touching.

In its simplest form, the fastening means of the present invention consists of a single pair of tab members. In practice, however, a plurality of tab members are normally used. In fact, the tabs are usually compounded in a linear row as shown in FIG. 1 and, more particularly, in a row which provides a minimum of three apertures for retaining the wire binder. The fastening means may extend the length of the insert as in FIG. 3A or extend only a portion of the insert as in FIG. 4. A variety of tab arrangements may be used depending on the end use. In accordance with the invention tab members may be formed with a notch and aperture forming portion on one side such as in the case of an end tab such as 28 in FIG. 1 where one side of the tab is essentially flat. Of course, the non-latching portions of the end tab may assume a variety of configurations, e.g, rounded, reinforced, etc.

For attaching the fastening means to the document or item to be inserted, the fastening means 10 in FIG. 1 may be provided with an optional layer of adhesive 30. Other means of attachment may also be used, one example of which is a double sided adhesive tape.

Figure 2A:
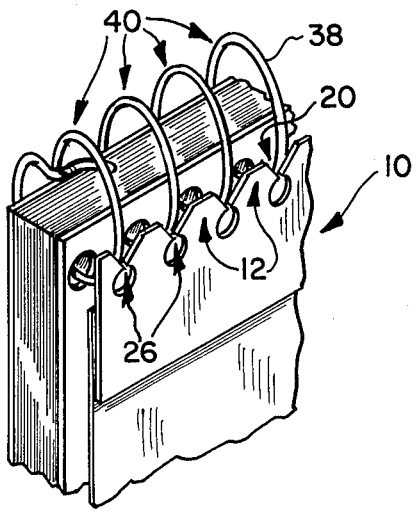
FIGS. 2A and 2B are partial isometric views illustrating insertion of the invention fastening means into a wire spiral such as is commonly employed to bind a notebook.
Figure 2B:
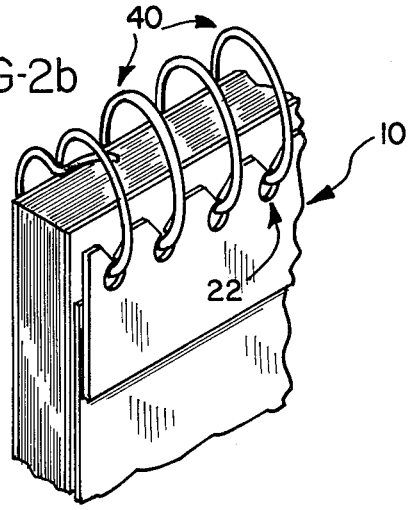

The attachment of the invention fastener to a wire binder is illustrated in FIG. 2 using the fastening means shown in FIG. 1. Tabs 12 are flexibly mounted on the base strip 14 so as to permit attachment of the fastening means 10 to a wire binder. This is typically accomplished as shown by positioning the fastening means 10 adjacent spiral wire 38 such that the tabs 12 are positioned between adjacent turns 40 of the spiral. In this case, the turns of the spiral 40 are approximately in line with the notches 20 on the fastening means as shown in FIG. 2*a*. Pressure on the tabs 12 causes the tabs to flex slightly. As the tabs flex the width of the opening 26 in the fastening means increases and permits the wire segment at the turn 40 of the spiral to slide from the notch 20 into the aperture 22 as shown in FIG. 2*b*. The wire at the turn 40 is retained in the aperture 22 when the tab 12 returns to its original position under its own flexibility and the opening 26 closes to its pre-flexed sized. Removal of the fastening means of the invention is accomplished by the reverse process. Pressure is applied to the tabs by pulling the base strip away from the wire bound volume. As the strip is pulled the opening between the notch and the aperture widens and releases the wire binder. The embodiment of FIG. 6 slips on and off the binder in a similar manner, however, because the tab head 18*a* is bulbous it tends to be easier to slide on and off the binder. The FIG. 6 fastener can be slipped on the wire binder without exerting downward pressure on individual tab members.

Figure 3A:
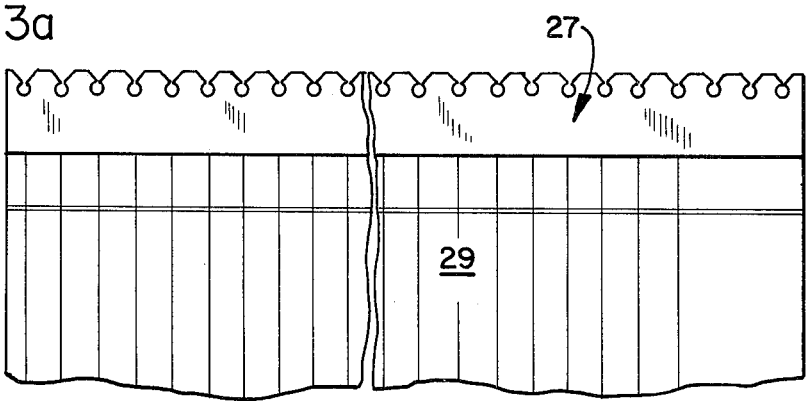
FIGS. 3A and 3B illustrate another embodiment of the invention.
Figure 4:
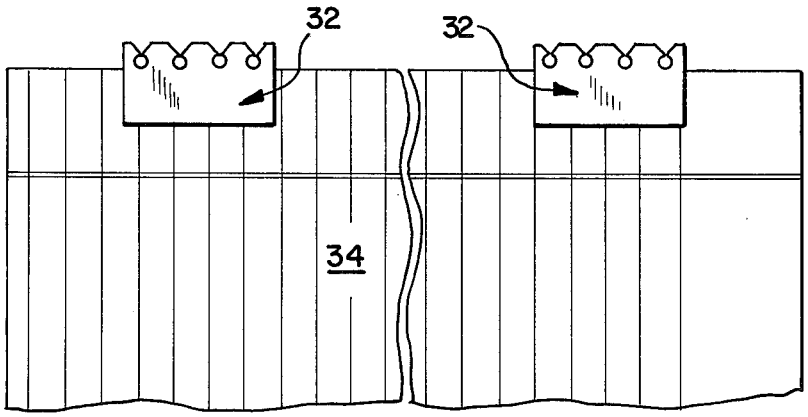
FIG. 4 is a partial plan view of still another embodiment of the invention.

The number of tabs employed in any fastening means is a matter of choice. The tabs will always be positioned such that one segment of the wire binder is retained between each pair of tabs, however, the number or wire segments retained by a single fastening means may vary from one to the total number of turns in the binder. The fastening means of the present invention may extend the entire length of the document to be inserted as shown in FIG. 3A where the fastener 27 occupies the length of the insert 29 and, as shown in FIG. 2B, is adhered to the insert via a layer of adhesive 21. Alternatively the fastener may occupy only a portion of the border as shown in FIG. 4 where the fastening means 32 are attached to the top and bottom portions of a sheet of paper 34. Alternatively, a single pair of tab members may be spaced at a standard interval of, for example, 1" along the length of the insert. Variations on this arrangement are also possible where, for example, tab members in groups of two, three or four are spaced at standard intervals in the margin of the insert. A large variety of arrangements and number of tabs may be chosen from depending upon the end use.

The fastening means of the present invention is formed of a material which is flexible and resists stretching and tearing. Suitable materials include reinforced paper such as a resin coated or plastic lined paper. Some heavier weight papers or cards may also be used but their useful life may be limited by their more limited ability to resist tearing. Plastics such as polyesters, polyethylene, polypropylene, and other available polymers are generally preferred, particularly for the embodiment of FIG. 6. The flexibility of the strip is also a function of its thickness and, accordingly, the material and thickness of the fastening means are selected such that the desired stretching and tearing resistance are obtained and the fastening means is flexible enough to be inserted and detached from the wire binder in the manner described above.

Figure 3B:
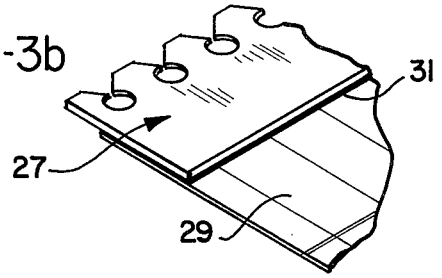

The fastening means of the present invention may assume a number of embodiments. In the embodiment illustrated in FIG. 1, the fastener comprises a base strip 14. This strip is generally about 0.5 to 0.75 inch wide. The strip may be attached at the edge of a document, page, divider or the like for insertion using a layer of adhesive or other suitable attachment means. Where an adhesive is employed it is convenient to provide the adhesive on the fastening means as shown in FIG. 1 by the layer 30. Where the fastening means is supplied in this manner, to facilitate handling the layer of adhesive is protected with a releasable protective sheet such as silicone or fluorocarbon release papers, which can be peeled from the fastening means by hand prior to its attachment to the item to be inserted. Of course, page inserts, dividers and the like may be supplied with the fastening means of the present invention pre-attached as shown in FIG. 3 above.

In accordance with another embodiment of the invention, the fastening means is used to affix a pencil or utility pouch to a notebook. Such a pouch is shown in FIG. 5 where the fastening means 36 is affixed to a plastic support 38 having attached thereto a second outlet plastic sheet 39 so as to form a pouch. The pouch is closable by means such as the slide zipper 42. The fastener may also be integrally molded on one side of a ruler for attachment to a notebook or the fastener may be molded with a channel-shaped clip for holding a tablet or note pad in a wire bound notebook. The latter embodiments would likely be fabricated by injection molding for which the FIG. 6 fastener is particularly desirable.

While the present invention has been explained by reference to a spiral wire binder, it will be readily apparent to those skilled in the art that its teachings are equally applicable to other wire binders. In particular, with appropriate modifications, the fastening means of the present invention may be used in conjunction with a double wired cylindrical binder.

Having described the invention in detail and by reference to specific embodiments thereof, it will be apparent that numerous variations and modifications therein are possible without departing from the invention defined in the following claims.

What is claimed is:

1. A fastening means for attachment to a wire binder comprising a plurality of adjacently positioned tabs attached in a linear row to a base strip, each of said tabs being formed with the bulbous head portion and a post-like neck portion such that the head portions on two adjacent tabs form a V-shaped notch in the space between said tabs and the neck portions on two adjacent tabs form a generally circular aperture in the space between said tabs and an opening is formed between said notch and said aperture having a sufficient width such that said wire forming said binder passes from said notch into said aperture when one of said adjacent tabs is flexed out of a plane containing the other of said tabs and said wire is retained in said aperture when said tabs are not flexed.

2. A fastening means for attaching a sheet member to a spiral wire binder, said fastening means being attached along one edge of a sheet member by means of a base strip, said base strip having a plurality of coplanar adjacently positioned tabs attached thereto in a linear row and extending outwardly from the edge of said sheet member, said tabs having a neck portion and a head portion, wherein said neck portion extends directly from said base strip and terminates in said head portion, said head portion having two oblique surfaces and said neck portion having two arcuate surfaces such that the oblique surfaces on two adjacently positioned tabs form a V-shape notch in the space between said head portions and the arcuate surfaces on two adjacent tabs form a circular aperture in the space between said neck portions, wherein said oblique surfaces have a point of convergence on the circumference of said aperture immediately adjacent said notch where a direct opening is formed between said notch and said aperture, said notch, opening and aperture being dimensioned so as to permit a turn of the wire forming said binder to pass from said notch into said aperture when one of said adjacent tabs is flexed out of a plane containing the other of said adjacent tabs and to retain a turn of said wire in said aperture when said adjacent tabs are coplanar.

3. The fastening means of claim 2 wherein said base strip is coated with an adhesive composition.

4. The fastening means of claim 2 wherein said fastening means is attached to a utility pouch.

5. The fastening means of claim 2 wherein said opening is a slit.

6. The fastening means of claim 2 wherein said fastening means is formed of a synthetic plastic material.

* * * * *